US006912745B2

(12) United States Patent
Masoncup

(10) Patent No.: US 6,912,745 B2
(45) Date of Patent: Jul. 5, 2005

(54) BED SKIRT AND METHODS OF MANUFACTURE AND USE

(76) Inventor: John F. Masoncup, 610 N. Maple Ct., Mount Prospect, IL (US) 60056

( * ) Notice: Subject to any disclaimer, the term of this patent is extended or adjusted under 35 U.S.C. 154(b) by 0 days.

(21) Appl. No.: 10/444,744

(22) Filed: May 24, 2003

(65) Prior Publication Data

US 2004/0231053 A1 Nov. 25, 2004

(51) Int. Cl.[7] ..... A47G 9/02
(52) U.S. Cl. ..... 5/493; 5/482
(58) Field of Search ..... 5/482, 493; 297/228.11

(56) References Cited

U.S. PATENT DOCUMENTS 4,807,316 A * 2/1989 Whipple ..... 5/493
5,353,456 A * 10/1994 Evans ..... 5/493
5,621,931 A * 4/1997 Hamilton ..... 5/493
5,638,562 A 6/1997 Masoncup
5,715,553 A * 2/1998 Baron et al. ..... 5/493
5,966,758 A * 10/1999 Karam ..... 5/493
6,035,469 A * 3/2000 Schrougham ..... 5/493
6,119,290 A 9/2000 Masoncup
6,151,731 A * 11/2000 Saparow ..... 5/493
6,598,249 B2 * 7/2003 Pajanacci et al. ..... 5/493

* cited by examiner

*Primary Examiner*—Michael Trettel
(74) *Attorney, Agent, or Firm*—Meroni & Meroni, P.C.; Charles F. Meroni, Jr.

(57) ABSTRACT

A bed skirt for positioning between a mattress and a box springs of a bed. The bed skirt has a side fabric panel for covering a first side of the box springs with a corner cap fold at one end for covering a corner of the box springs during use. A foot fabric panel covers a second side of the box springs perpendicular to the first side of the box springs. A fabric cap connects an edge of the first panel to an edge of the second panel adjacent the corner cap of the first panel providing a convertible corner allowing the corner cap to optionally cover a corner of the box springs during use or straddle a bed frame member during use. A cord within the fabric cap frictionally holds the side panel and foot panel in place between the box springs and the mattress during use.

36 Claims, 7 Drawing Sheets

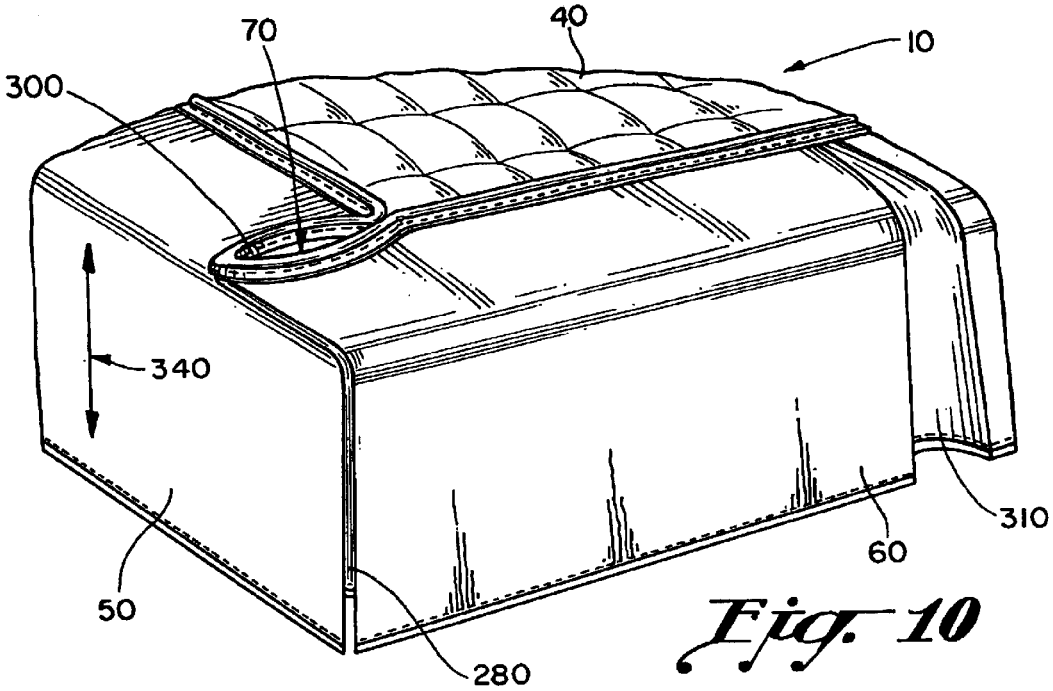
Fig. 10
Fig. 11
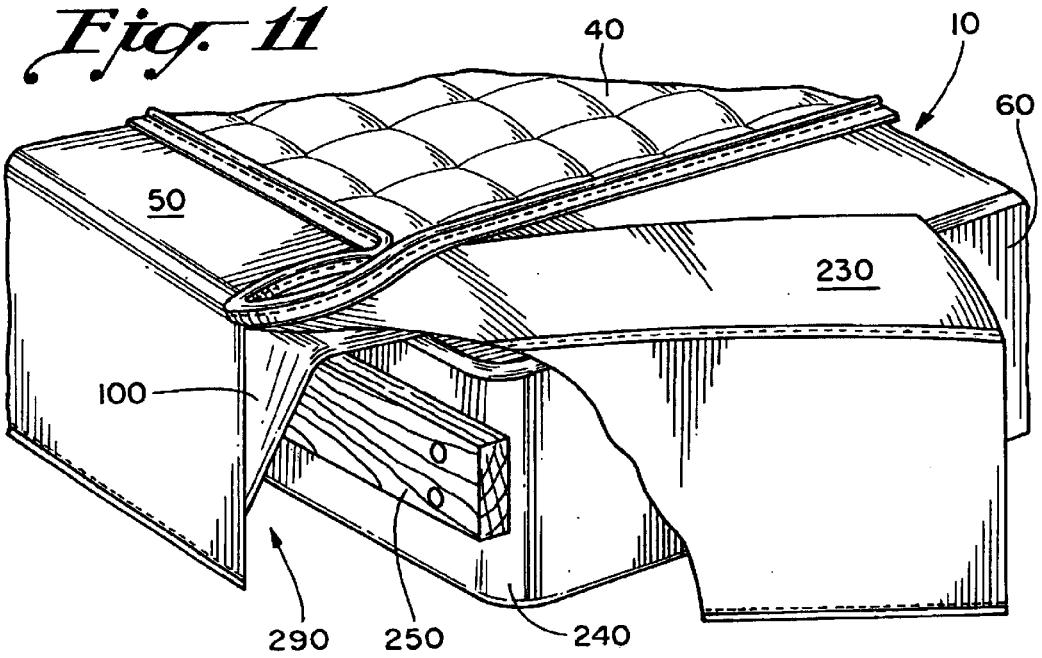

BED SKIRT AND METHODS OF MANUFACTURE AND USE

BACKGROUND OF THE INVENTION

1. Field of the Invention

The present invention relates generally to bed skirts, and more specifically relates to a bed skirt having hinged corners for independent panel adjustment and optional box springs corner covering.

2. Background of the Invention

Bed skirts have been used for many years for covering the box springs portion of a bed to provide an aesthetically pleasing appearance to the bed. Typically, bed skirts have a solid center platform portion that is placed over the top of the box springs and a panel portion connected to the platform that hangs over the sides of the box springs to hide the box springs from view. In order to install a bed skirt of this type, the mattress has to be removed from the box springs before the skirt can be placed over the box springs. It is often difficult to remove the mattress from the box springs due to the size and weight of the mattress. Removing the mattress from the box springs can also be a problem due to the lack of available space around the bed where night stands, lamps and chairs become obstacles.

To provide an answer to the need for a bed skirt that could be installed without having to remove the mattress from the box springs, Applicant invented a fitted bed sheet for placement over the mattress that provided fastening means for a bed skirt to be attached thereto. This bed cover structure with improved dust ruffle is disclosed in U.S. Pat. No. 5,638,562 issued to Applicant. Another example of this type of bed skirt is U.S. Pat. No. 6,035,469 issued to Schrougham. Schrougham discloses a bed skirt having a downwardly extending ruffle and panel sections that are tucked between an upper and box springs to maintain the skirt in a proper position and alignment with respect to the box springs.

After a conventional bed skirt is positioned over the box springs, the mattress is placed on top of the box springs with the platform between the box springs and mattress. It is often a problem to place the mattress over the platform without shifting the bed skirt out of place due to the mattress moving the platform when the mattress is slid across the top of the platform. To provide an answer to the need for a bed skirt that could be installed without having to remove the mattress from the box springs and eliminate the problems associated with having a platform portion, Applicant invented a dust ruffle structure that does not require a center platform portion. This dust ruffle structure is disclosed in U.S. Pat. No. 6,119,290 issued to Applicant.

The side panels and foot panel of a conventional bed skirt are attached to the platform portion and are maintained in a fixed relationship with one another. Due to the fixed relationship between the side panels and the foot panel of the bed skirt, adjustment of one of the panels effects the position of the other panels resulting in compromising placement of one or more panels of the bed skirt. Bed skirts have been conceived that provide limited adjustability, such as U.S. Pat. No. 6,276,009 issued to Schrougham. Schrougham discloses a bed skirt having a downwardly extending ruffle and panel sections that are tucked between an upper and box springs or box springs to maintain the bed skirt in a proper position and alignment with respect to the box springs or box springs. The panel sections are discontinuous or partially discontinuous and are equipped with adjustable fasteners that are used to secure the positioning o the panel section with respect to each other.

A further problem that is encountered when utilizing a bed skirt is accommodating beds having a foot board at the foot of the bed. This is typically compensated for by providing a bed skirt having a gap at the corners between the side panels and the foot panels. However, bed skirts of this type can not be used in applications where a foot board is not used due to the fact that the gap between the foot panel and side panels leave a portion of the box springs exposed. Therefore, there is a need for a multipurpose bed skirt that can be used in applications where a foot board is utilized and in applications where a foot board is not utilized.

SUMMARY OF THE INVENTION

In order to provide a bed skirt that solves many of the needs previously mentioned, as well as others that will become apparent after a reading of this specification and a review of the appended drawings, the claimed invention provides an Improved Bed Skirt and Methods of Manufacture and Use.

A major objective of the claimed invention is to provide a bed skirt that can be used in applications where a foot board may or may not be present.

Another objective of the claimed invention is to provide a bed skirt that can be installed without having to remove the mattress from the box springs.

A further objective of the claimed invention is to provide a bed skirt eliminating the problems associated with having a platform portion.

An even further objective of the claimed invention is to provide a bed skirt that allows a greater degree of independent adjustability amongst the side panels and foot panel.

To achieve these objectives, a bed skirt for positioning between a mattress and box spring of a bed is provided. The bed skirt has side fabric panels for covering sides of the box spring with a corner cap fold at an end of each side panel for covering a corner of the box spring during use. A foot fabric panel covers an end of the box springs perpendicular to the sides of the box springs. A fabric cap connects an edge of the side panels to an edge of the foot panel adjacent the corner cap of the side panels providing a convertible corner allowing the corner cap to optionally cover a corner of the box springs or straddle a bed frame member during use. A cord within the fabric cap frictionally holds the side panel and foot panel in place between the box springs and the mattress during use.

The claimed invention also provide a method of manufacturing a bed skirt having a convertible corner section. The method comprises folding an end of a pair of side fabric panels sized and shaped to cover the sides of a box spring toward the center of the panels to form a return fabric panel at an end of each of the panels. A foot fabric panel for covering an end portion of box spring is attached to the side fabric panels by a separately cut fabric cap. The fabric cap is sewn to edges of the side fabric panels, edges of the return fabric panels and an edge of the foot fabric panel connecting the fabric panels into a continuous item. A portion of the fabric cap is then stitched adjacent the return fabric panel to a portion of the fabric cap adjacent the foot fabric panel forming a hinge portion of the foot fabric panel completing the hinge portion of the bed skirt.

The claimed invention further provides a method of installing a bed skirt. The method comprises first inserting a first fabric panel of the bed skirt having a frictional retention cord between the box springs and the mattress. A pleated corner portion of a bed skirt between a box spring and a mattress of a bed is then inserted between the box springs and the mattress. A second fabric panel of the bed skirt having a frictional retention cord is then inserted between the box springs and the mattress of the bed. Then a corner cap placement selection is made between a bed frame member straddle configuration and a box springs corner cap configuration. If the bed frame member straddle configuration is selected, the corner cap is tucked adjacent the first fabric panel or second fabric panel so as to allow the bed frame member to extend between the first fabric panel and second fabric panel during use. If a box springs corner cap configuration is selected, the corner cap is extended to cover a corner of the box springs and the end of the corner cap is covered with a portion of the first fabric panel or second fabric panel. The method of installation further comprises adjusting the first fabric panel with the pleated corner being held stationary between the box springs and the mattress thus allowing independent movement of the first fabric panel. The second fabric panel is then adjusted with the pleated corner being held stationary between the box springs and the mattress allowing independent movement of the second fabric panel.

BRIEF DESCRIPTION OF THE DRAWINGS

FIG. 1 illustrates the bed skirt of the claimed invention installed on a bed utilizing a foot board.

FIG. 2 illustrates a cross sectional view of how the bed skirt is inserted between the box springs and mattress of a bed.

FIG. 3 illustrates shows how the friction means functions between the mattress and box springs.

FIG. 4 is an enlarged view of the frictional engagement of the cord between the mattress and box springs.

FIG. 5 illustrates a perspective view of the bed skirt of the claimed invention.

FIG. 6 shows an exploded view of the bed skirt of the claimed invention.

FIG. 6*a* shows an enlarged view of the hinged corner of the bed skirt.

FIG. 7 illustrates a cross sectional view of how the fabric cap connects retains the cord and attaches to the panel of the bed skirt.

FIG. 8 is a perspective view of the bed skirt of the claimed invention positioned over box springs with portions folded back to show detail.

FIG. 9 illustrates how the return fabric panel is used to cover the corner of the box springs.

FIG. 10. FIG. 10 illustrates completed installation of the bed skirt on box springs without a foot board.

FIG. 11. FIG. 11 shows a perspective view of the bed skirt of the claimed invention positioned over box springs with a side board for connection to a foot board.

FIG. 12 illustrates completed installation of the bed skirt on box springs with a side board.

FIG. 13 shows a cross sectional view of the overlapped relationship between the panels of the bed skirt.

FIG. 14 shows a top view of the relationship between the panels of the bed skirt.

DETAILED DESCRIPTION OF THE PREFERRED EMBODIMENT

Figure 1:
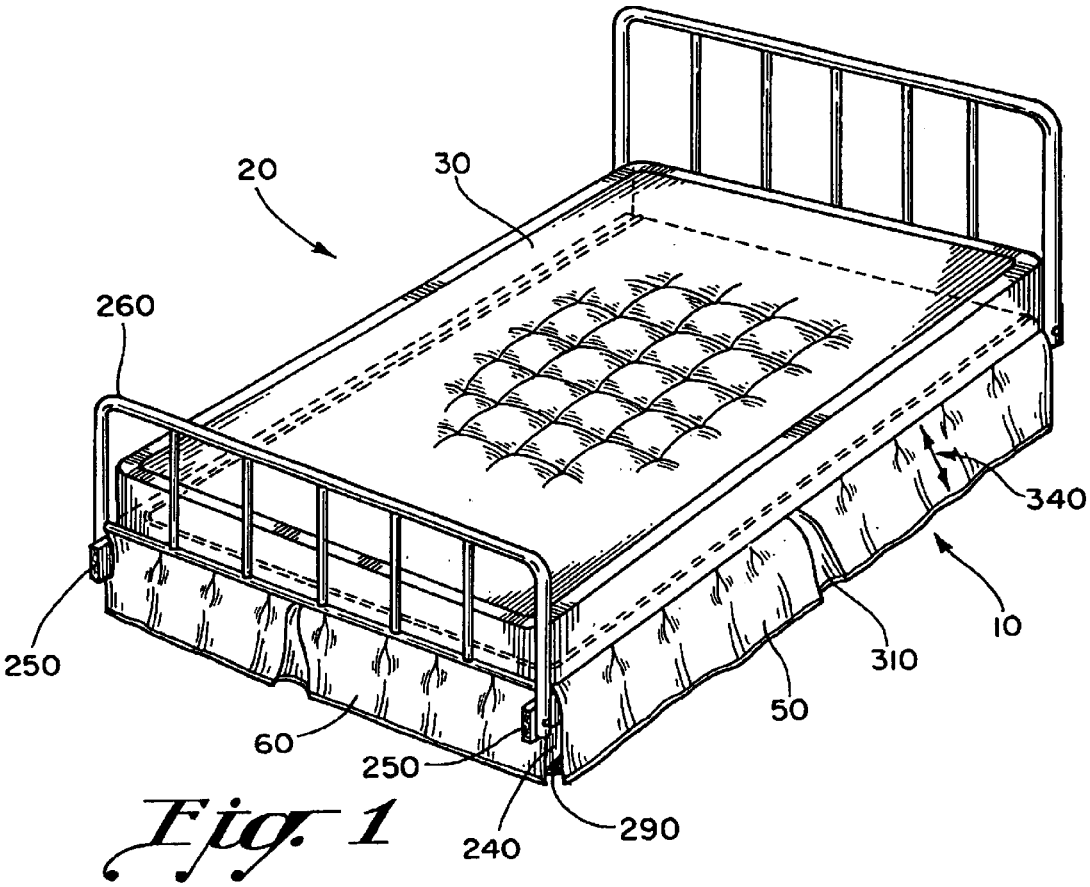
FIG. 1.
Figure 2:
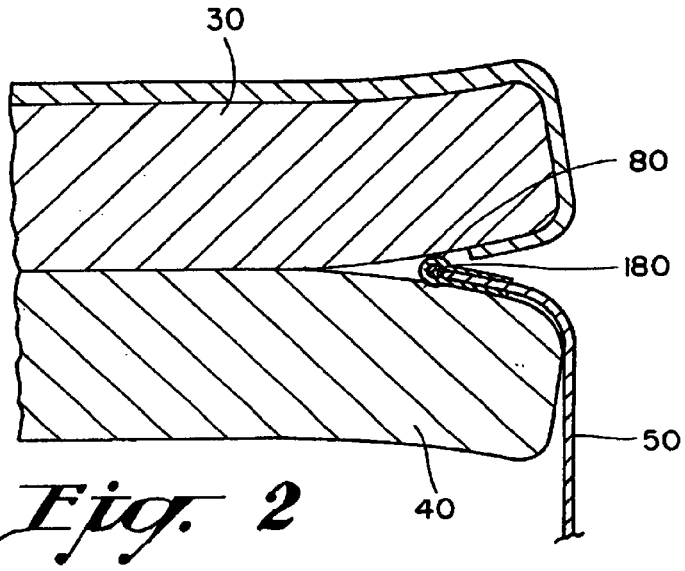
FIG. 2.
Figure 5:
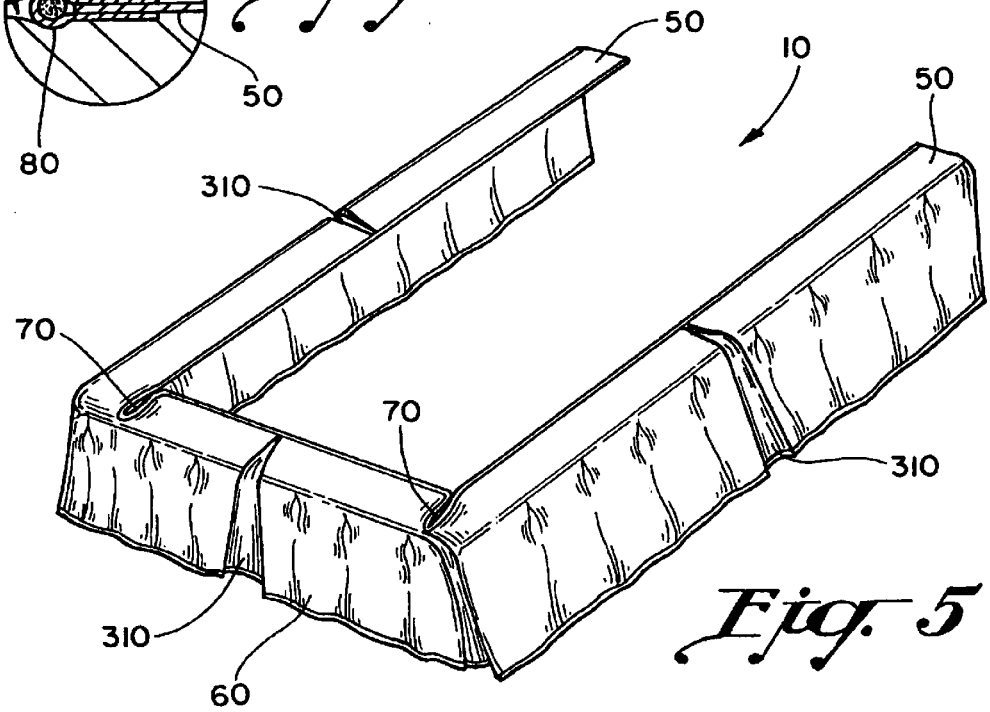
FIG. 5.
Figure 6:
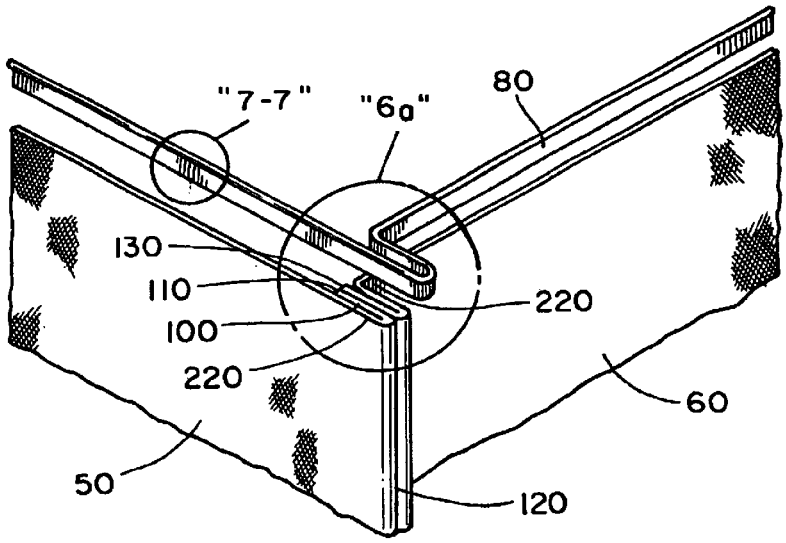
FIG. 6.
Figure 6A:
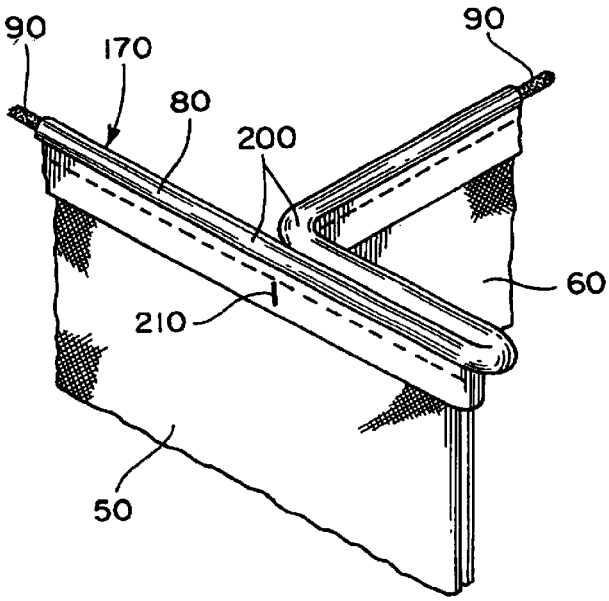
FIG. 6*a*.

Turning now to the drawings, FIGS. 1 and 5 show a preferred embodiment of the bed skirt 10 for use with a bed 20 having an mattress 30 and a lower mattress or box springs 40. While the bed skirt 10 illustrated in the drawings shows a box pleated bed skirt, it should be understood that the utility of the claimed invention does not depend upon the style of bed skirt. The unique aspects of the claimed invention can be included in any bed skirt regardless of style. FIGS. 5–6*a* show that the bed skirt 10 generally comprises a pair of side fabric panels 50 connected to a foot fabric panel 60 by a pair of hinged or pleated corners 70, a fabric cap 80, and a cord 90.

The panels 50, 60 of the bed skirt 10 shown in FIGS. 1 and 5 are sized and shaped to cover three sides of the box springs 40 when the bed skirt 10 is hand tucked between the box springs 40 and the mattress 30. Each of the side fabric panels 50, 60 have a return fabric panel 100 as shown in FIG. 6 with a return end 110 that are made with a fold 120 perpendicular to the length of the side fabric panel 50 toward the center of the panel 50. The panels 50, 60 of the bed skirt 10 may be made from a variety of fabrics in a variety of different sizes to accommodate many different applications. Each of the panels 50, 60 can also be made in a variety of different styles, such as ruffled or pleated, depending upon the type of bed skirt desired. During assembly of the bed skirt 10, the ends 130 of the foot panel 60 are placed in overlapped relation with the return panels 100 of the side panels 50 where the ends 130 of the foot panel 60 are aligned with the return ends 110 of the return panels 100 as shown in FIG. 6.

Figure 7:
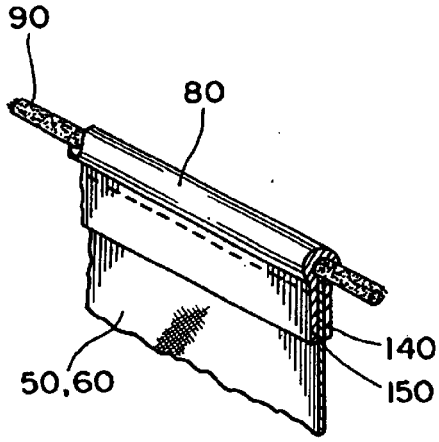
FIG. 7.

The fabric cap 80 shown in FIGS. 6 and 7 is a separate piece of fabric having a first leg or edge 140 that is sewn along the length of one side of the bed skirt panels 50, 60 joining the side fabric panels 50 to the foot fabric panel 60. The cord 90 shown in FIGS. 6*a* and 7 that is used to frictionally hold the bed skirt 10 in place between the box springs 40 and the mattress 30 is placed adjacent the connection between the fabric cap 80 and the panels 50, 60. The cord 90 used in the bed skirt 10 can be made from a variety of different materials and in a variety of different diameters, with the preferred diameter being in the range of from about 8⁄32 inches to about 12⁄32 inches.

Figure 3:
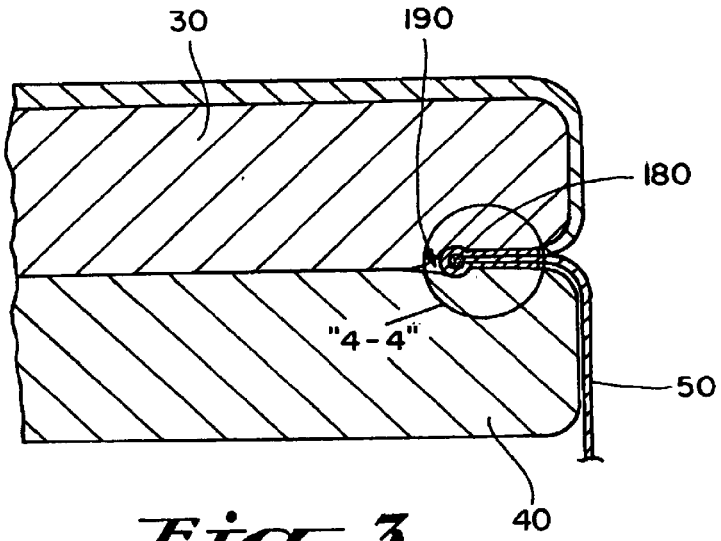
FIG. 3.
Figure 4:
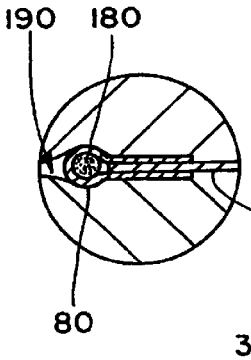
FIG. 4.

The opposite leg or edge 150 of the fabric cap 80 is then sewn to the opposite sides of the bed skirt panels 50, 60, forming a pocket 160 along the length of the panels 50, 60 holding the cord 90 in place as shown in FIGS. 6*a* and 7. The fabric cap 80 and cord 90 form a top edge 170 of the bed skirt 10 as shown in FIGS. 5 and 6*a* that is engulfed by the box springs 40 and the mattress 30 as a friction means for frictionally maintaining the position of the bed skirt 10 in relation to the box springs 40 and mattress 30 as shown in FIG. 1. The frictional engagement of the top edge 170 of the bed skirt 10 with the bed 20 is formed by the diameter 180 of the cord 90 within the fabric cap 80 making an indentation 190 in the box spring 40 and mattress 30 as shown in FIGS. 3 and 4 that creates a resistance against movement of the bed skirt 10. The engulgment of the top edge 170 of the bed skirt 10 makes it possible to provide a bed skirt without the need for a center platform portion, contributing substantially to the flexibility of positioning and adjustment that the claimed invention possesses.

Two points 200 of the fabric cap 80 are stitched 210 together adjacent the points 220 where the ends 130 of the foot panel 60 are aligned with the return ends 110 of the return panels 100 forming the hinged panel portion 230 of the foot fabric panel 60 and creating a pleat defining the hinged corners 70 of the bed skirt 10 as shown in FIGS. 5 and 6*a*. The hinged corners 70 are convertible to optionally cover a corner 240 of the box springs 40 or straddle a bed frame member 250 when the bed frame utilizes a foot board 260. This is an important aspect of the claimed invention in that the bed skirt 10 of the claimed invention can be used where two different bed skirts were previously used. The prior art previously provided either a continuous cornered bed skirt for use with a bed frame without a foot board or a split cornered bed skirt for use with a bed frame having a foot board so that the bed skirt would straddle the bed frame. The claimed invention effectively eliminates the need for these two types of bed skirts, combining the functional and aesthetic considerations into one single bed skirt 10.

The bed skirt 10 of the claimed invention allows installation without having to remove the mattress 30 from the box springs 40 by eliminating the need for a center platform portion. The bed skirt 10 is installed by first hand tucking the top edge 170 of one of the panels 50, 60 between the box springs 40 and the mattress 30. The panels 50, 60 may be inserted between the box springs 40 and mattress 30 without regard to the sequence of insertion with the order preferably being first inserting one of the side fabric panels 50, then inserting the foot fabric panel 60 and finally inserting the other side fabric panel 50. A selection depending upon the type of bed frame being used must be made during insertion of the hinged corners 70 between the box springs 40 and mattress 30.

Figure 8:
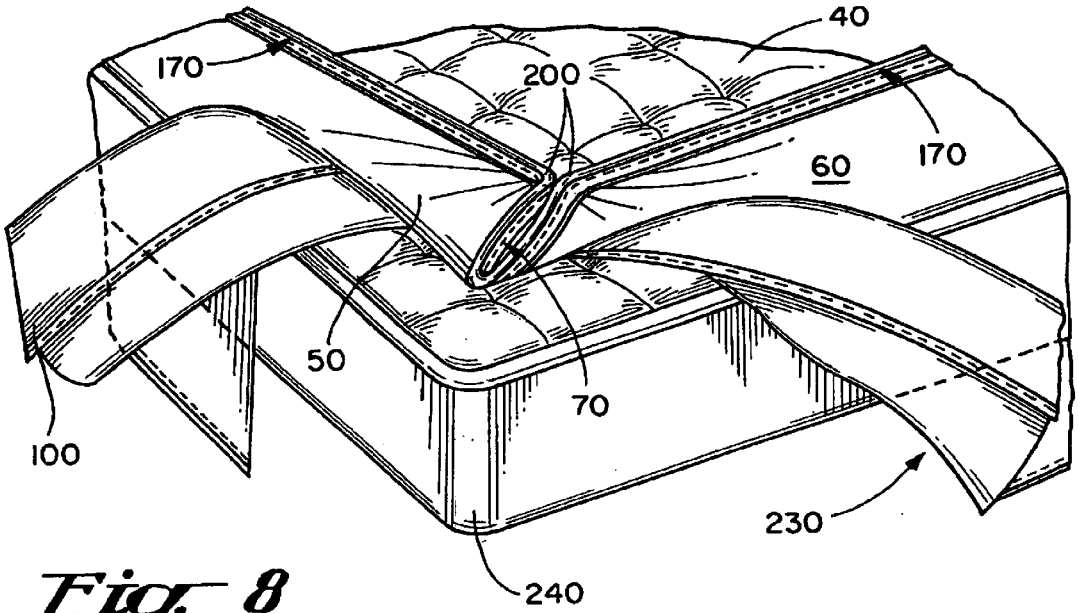
FIG. 8.
Figure 9:
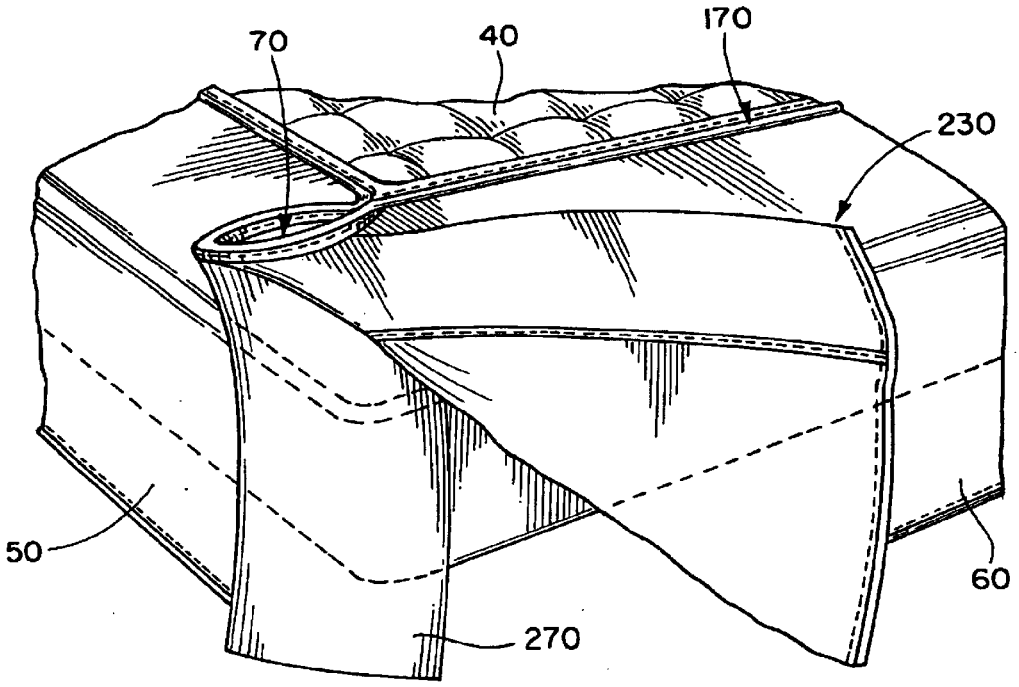
FIG. 9.

FIGS. 8–10 illustrate proper installation of the bed skirt 10 where the bed frame does not utilize a foot board 260. FIG. 8 shows the bed skirt 10 positioned over the box springs 40 with portions of side panel 50 and foot panel 60 folded back so as to show the return fabric panel 100 and the hinged panel portion 230 of the foot fabric panel 60. It should be understood that in actual installation of the bed skirt, the panels 50, 60 will be hand tucked between the box springs 40 and mattress 30 and then adjusted to provide the proper fall or drape of the panels 50, 60 from the box springs 40. The return fabric panel 100 or the hinged panel portion 230 may be used as a corner cap 270 to continuously cover the corner 240 of the box springs 40. Preferably, the return fabric panel 100 is used as illustrated in FIG. 9 to cover the corner 240 of the box springs 40 so that the opening 280 between the foot fabric panel 60 and the side fabric panels 50 are oriented to the side of the bed 20 resulting in the foot fabric panel 60 having a clean aesthetic appearance as shown in FIG. 10.

Figure 12:
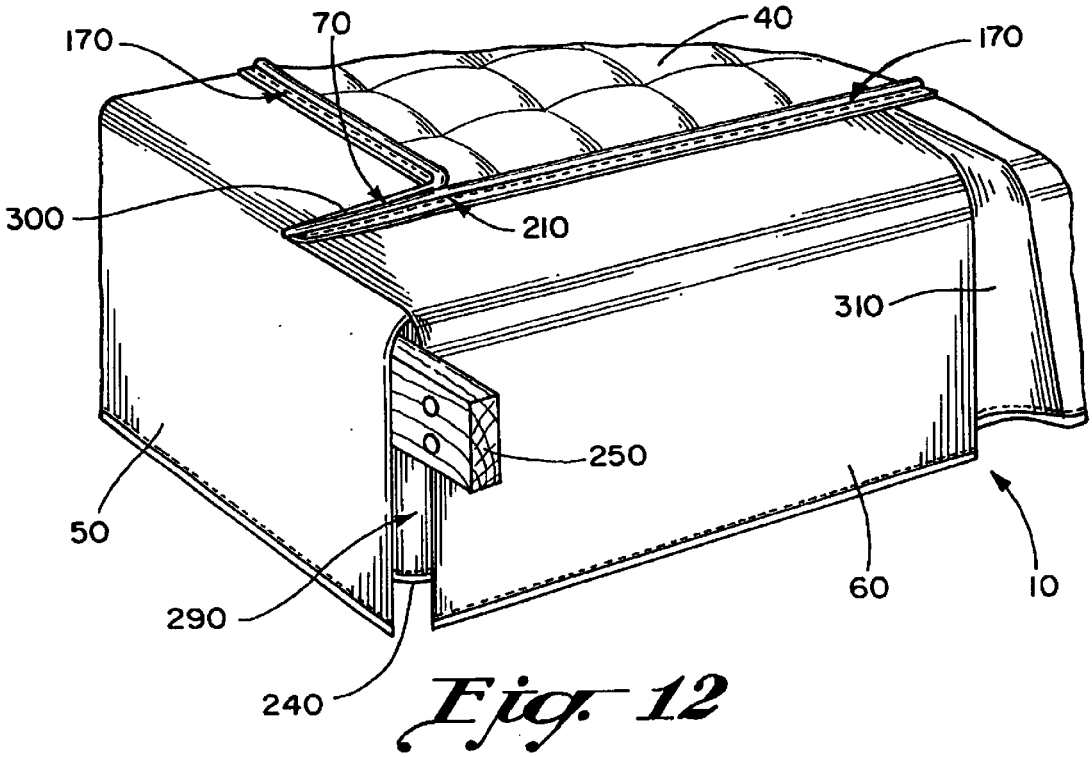
FIG. 12.

FIGS. 11–12 illustrate proper installation of the bed skirt 10 where the bed frame has side boards 250 extending beyond the box springs 40 for connection to a foot board 260. FIG. 11 shows the bed skirt 10 positioned over the box springs 40 with the hinge panel portion 230 of the foot panel 60 folded back so as to show how the return fabric panel 100 is tucked adjacent the side fabric panel 50 to created a gap 290 between the side fabric panel 50 and foot fabric panel 60 so that the bed skirt 10 straddles the side boards 250 of the bed frame. FIG. 12 shows the bed skirt 10 after completion of installation.

Figure 13:
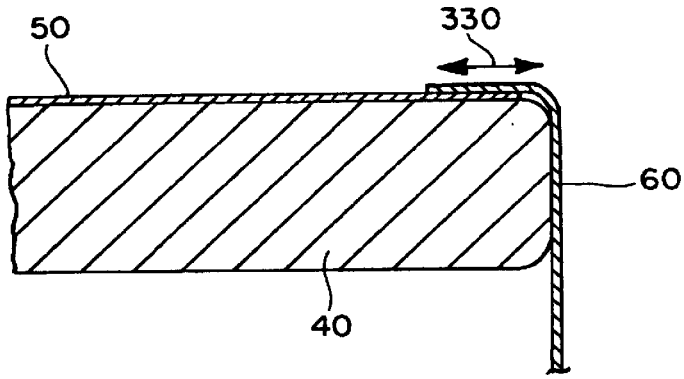
FIG. 13.
Figure 14:
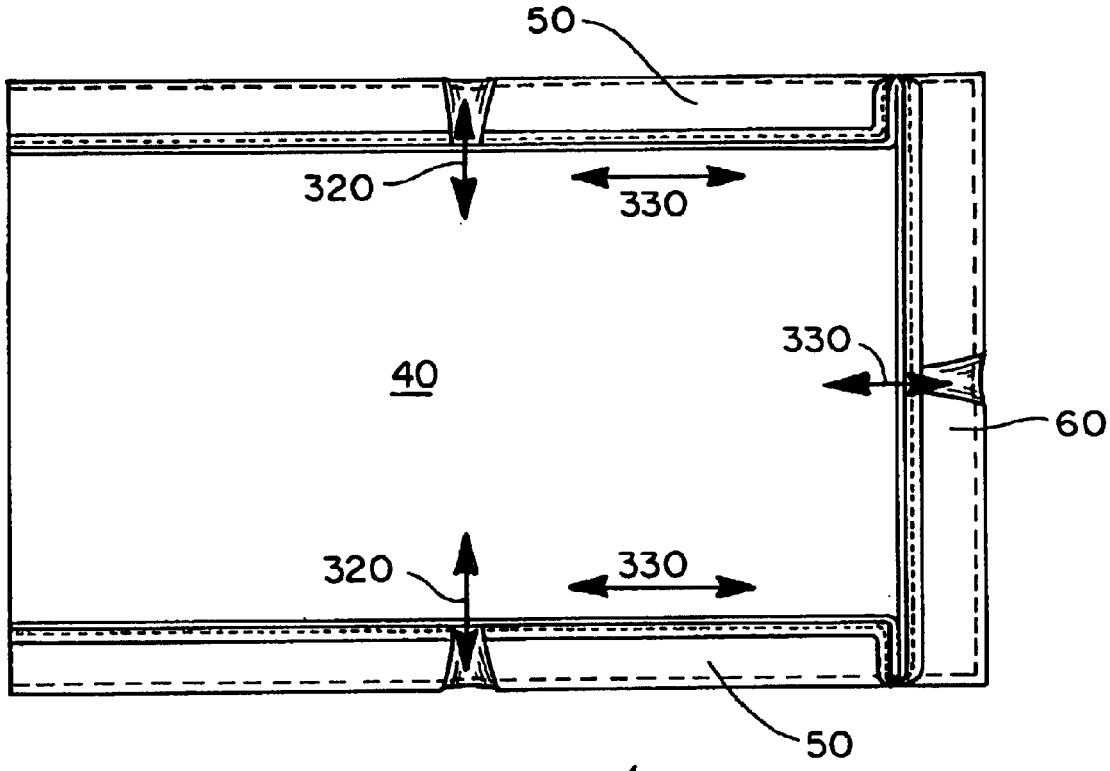
FIG. 14.

After the hinged corners 70 have been configured for the particular type of bed being used, each of the panels 50, 60 can be individually adjusted without substantially altering placement of the other panels due to the unique structure of the hinged corners 70. Each side fabric panel 50 is a separate piece of fabric connected to the foot fabric panel 60 by the fabric cap 80 being stitched to a common edge of the panels 50, 60 as shown in FIG. 6*a*. This partial attachment allows the side fabric panels 50 to be adjusted individually while leaving the portion connected to the foot fabric panel 60 stationary. When the bed skirt 10 is hand tucked between the mattress 30 and box springs 40, the hinged corners 70 are preferably oriented so that the fabric cap portion 300 of the hinged corners 70 are in line with the fabric cap of the foot fabric panel 60, as shown in FIG. 12, overlying the side fabric panels 50. This overlapped relationship allows the top edges 170 of the panels 50, 60 to be adjusted laterally 320 and longitudinally 330 in different overlapping planes as shown in FIGS. 13 and 14.

The box pleat style bed skirt typically has a box pleat 310 that is to be positioned roughly at the midpoint of each side of the box springs 40 as shown in FIG. 1. Previously, it was difficult to adjust bed skirts of the prior art having center platforms due to the fixed relationship between the panels. This difficulty coupled with the fitted appearance of the box pleat bed skirt allowing very little excess material for use in compensating shifting other portions of the bed skirt made it difficult to properly position the box pleats in a traditional bed skirt. The ability to adjust each of the panels 50, 60 of the bed skirt 10 of the claimed invention as shown in FIGS. 13 and 14 without altering placement of the other panels is especially helpful when utilizing a box pleat style bed skirt as shown in FIGS. 1 and 5.

Another important aspect of the claimed invention is the adjustability of the fall or drape 340 of the bed skirt 10 over the box springs 40 that is achievable due to the relatively independent movement of the panels 50, 60. My dust ruffle type bed skirt patented in U.S. Pat. No. 6,119,290, the disclosure of which is expressly referenced and incorporated into this description, discussed the numerous advantages a bed skirt of the type claimed herein has over the prior art in adjusting the fall 340 of the bed skirt 10.

The claimed invention also provides a method of manufacturing the bed skirt. The method comprises first cutting a pair of side fabric panels 50 sized and shaped to cover the sides of a lower mattress or box springs 40. An end of each of the side fabric panels 50 are then folded to form a return fabric panel 100 at one end of each panel 50. A foot fabric panel 60 that has been separately cut to cover an end portion of the box springs 40 is then arranged so that the ends 130 of the foot fabric panel 60 will be aligned with the return end 110 of the return fabric panels 100. A fabric cap 80 that has been separately cut for attachment to an edge of the side fabric panel 50 and an edge of the foot fabric panel 60 is sewn to an edge of the side fabric panels 50, an edge of the return fabric panel 100 and an edge of the foot fabric panel 60 connecting the fabric panels 50, 60 into a continuous item. Two points 200 of the fabric cap 80 adjacent the return fabric panels 100 are stitched 210 together forming a hinge panel portion 230 of the foot fabric panel 60 and completing the hinged corners 70.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A bed skirt for use with a bed having a mattress and a box springs, the bed skirt comprising:

a side fabric panel of predetermined length having a fold perpendicular to the predetermined length providing a return fabric panel with a return end;

a foot fabric panel of predetermined length having a fastened end positioned adjacent the return end of the return fabric panel;

a fabric cap having a pocket along the length of the side fabric panel and length of the foot fabric panel fastened to an edge of the side fabric panel, an edge of the foot fabric panel and an edge of the return fabric panel, the foot fabric panel in overlapped relationship with the return fabric panel where the fastened end of the foot fabric panel is aligned with the return end of the return fabric panel providing an opening between the return fabric panel and the foot fabric panel;

a stitching connected at a point of the fabric cap adjacent the return end of the side fabric panel and to a point of the fabric cap adjacent the foot fabric panel defining a hinge portion of the foot fabric panel; and a cord within the pocket of the fabric cap.

2. The bed skirt of claim 1 wherein the fabric cap is a separate piece of fabric.

3. The bed skirt of claim 2 wherein the fabric cap further comprises a first leg and a second leg, the edge of the side fabric panel, the edge of the return fabric panel and the edge of the foot fabric panel stitched between the first leg and second leg.

4. The bed skin of claim 3 wherein the cord has a diameter of from about 8/32 inches to about 12/32 inches.

5. The bed skirt of claim 1 further comprising a second side fabric panel of predetermined length having a second fold perpendicular to the predetermined length of the second side fabric panel providing a second return fabric panel, the fabric cap fastened to an edge of the second side fabric panel and an edge of the second return fabric panel, the pocket of the fabric cap extended along the length of the second side fabric panel.

6. The bed skirt of claim 5 wherein the side fabric panel has at least one box pleat within the side fabric panel and the foot fabric panel has at least one box pleat within the foot fabric panel.

7. A bed skirt for positioning between a mattress and a box springs of a bed, the bed skirt comprising:

a side fabric panel for covering a first side of a box springs having a corner cap fold at one end for covering a corner of the box springs during use;

a foot fabric panel for covering a second side of the box springs perpendicular to the first side of the box springs;

a fabric cap connecting an edge of the first fabric panel to an edge of the second fabric panel adjacent the corner cap of the first fabric panel providing a convertible corner allowing the corner cap to optionally cover a corner of the box springs during use or straddle a bed frame member during use; and a cord within the fabric cap for frictionally holding the side fabric panel and foot fabric panel in place between a box springs and an mattress during use.

8. The bed skirt of claim 7 wherein the fabric cap is a separate piece of fabric.

9. The bed skirt of claim 8 wherein the fabric cap further comprises a first leg and a second leg, the edge of the side fabric panel and the edge of the foot fabric panel stitched between the first leg and second leg.

10. The bed skirt of claim 9 further comprising a second side fabric panel for covering a third side of a box springs parallel to the first side of the box springs having a second corner fold at one end for covering a corner of the box springs during use.

11. The bed skirt of claim 10 wherein the cord has a diameter of from about 8/32 inches to about 12/32 inches.

12. A method of manufacturing a bed skirt, the method comprising:

cutting a side fabric panel sized and shaped to cover a first side of a bed mattress during use;

folding a return fabric panel at one end of the side fabric panel;

cutting a foot fabric panel sized and shaped to cover a second side of a bed mattress perpendicular to the first side of the bed mattress during use;

cutting a fabric cap sized and shaped for attachment to an edge of the side fabric panel and an edge of the foot fabric panel;

sewing the fabric cap to an edge of the side fabric panel, an edge of the return fabric panel and an edge of the foot fabric panel connecting the side fabric panel, return fabric panel and foot fabric panel into a continuous item; and stitching a portion of the fabric cap adjacent the return fabric panel to a portion of the fabric cap adjacent the foot fabric panel forming a hinge portion of the foot fabric panel.

13. A method of installing a bed skirt, the method comprising:

inserting a pleated corner portion of a bed skirt between a box springs and a mattress of a bed;

inserting a first fabric panel of the bed skirt having a frictional retention cord between a box springs and a mattress of a bed;

inserting a second fabric panel of the bed skirt having a frictional retention cord between the box springs and the mattress of the bed; and selecting placement of a corner cap between a bed frame member straddle configuration and a mattress corner cap configuration.

14. The method of claim 13 further comprising tucking the corner cap adjacent the first fabric panel or second fabric panel and allowing the bed frame member to extend between the first fabric panel and second fabric panel during use.

15. The method of claim 13 further comprising extending the corner cap to cover a corner of the box springs during use and covering an end of the corner cap with a portion of the first fabric panel or second fabric panel.

16. The method of claim 13 further comprising adjusting the first fabric panel, the pleated corner being held stationary between the box springs and the mattress allowing independent movement of the first fabric panel.

17. The method of claim 16 further comprising adjusting the second fabric panel, the pleated corner being held stationary between the box springs and the mattress allowing independent movement of the second fabric panel.

18. A platformless bed skirt having:

a first fabric panel and a second fabric panel permanently joined by a convertible hinged corner portion providing at least one fabric cover for a corner of a mattress during use and a gap between the first fabric panel and the second fabric panel far straddling a bed frame member during use, a friction means for frictionally retaining a portion of the bed skirt between a lower bed mattress and an upper bed mattress during use, a fabric cap connecting the friction means to the first fabric panel and second fabric panel, and the friction means is a cord with a diameter of from about 8/32 inches to about 12/32 inches.

19. A bed skirt for covering the sides of a box spring positioned below a mattress, the bed skirt comprising:

a side fabric panel for covering a first side of a box spring during use;

a foot fabric panel for covering a second side of the box spring during use perpendicular to the first side of the box spring;

a fabric cap connecting an edge of the side fabric panel to an edge of the foot fabric panel;

a pleased corner position the foot fabric panel and the side fabric panel in lapped relation providing multiplanar movement of the side fabric panel and the foot fabric panel during use;

a foot fabric panel for overlapping the side fabric panel; and a pleated corner comprising a stitching connecting a point of the fabric cap adjacent the side fabric panel to a point of the fabric cap adjacent the foot fabric panel.

20. The bed skirt of claim 19 further comprising a friction means for frictionally retaining a portion of the bed skirt between the box springs and the mattress during use.

21. The bed skirt of claim 20 wherein the friction means is a cord with a diameter of from about 8/32 inches to about 12/32 inches.

22. The bed skirt of claim 21 further comprising a corner cap for covering a corner of the box springs during use.

23. A bed skirt for covering the sides of a box springs positioned below a mattress, the bed skirt comprising:

a side fabric panel for covering a first side of a box springs having a corner cap fold at one end for covering a corner of the box springs during use;

a foot fabric panel for covering a second side of the box springs perpendicular to the first side of the box springs;

a fabric cap connecting an edge of the first fabric panel to an edge of the second fabric panel adjacent the corner cap of the first fabric panel providing a convertible corner allowing the corner cap to optionally cover a corner of the box springs during use or straddle a bed frame member during use; and a cord within the fabric cap for engulfment between a box springs and mattress during use holding the side fabric panel and foot fabric panel in place between a box springs and an mattress during use.

24. The bed skirt of claim 23 wherein the fabric cap is a separate piece of fabric, the fabric cap engulfed between the box springs and mattress during use.

25. The bed skirt of claim 24 wherein the fabric cap further comprises a first leg and a second leg, the edge of the side fabric panel and the edge of the foot fabric panel stitched between the first leg and second leg.

26. The bed skirt of claim 25 further comprising a second side fabric panel for covering a third side of a box springs parallel to the first side of the box springs having a second corner fold at one end for covering a corner of the box springs during use.

27. A bed skirt having a first fabric panel and a second fabric panel joined by a convertible hinged corner portion providing a fabric cover for a corner of a mattress during use and a gap between the first fabric panel and the second fabric panel for straddling a bed frame member during use, a cord with a diameter of from about 8/32 inches to about 12/32 inches within a fabric cap connected to the bed skirt frictionally retaining a portion of the bed skirt between a lower bed mattress and an upper bed mattress.

28. The bed skirt of claim 27 further comprising a corner cap for covering a corner of the box springs during use.

29. A bed skirt for covering the sides of a box springs positioned below a mattress, the bed skirt comprising:

a side fabric panel for covering a first side of a box springs during use;

a foot fabric panel for covering a second side of the box springs and overlapping the side fabric panel during use perpendicular to the first side of the box springs;

a fabric cap connecting an edge of the side fabric panel to an edge of the foot fabric panel; and a pleated corner positioning the foot fabric panel and the side fabric panel in lapped relation providing multiplanar movement of the side fabric panel and the foot fabric panel during use, the pleated corner having a stitching connecting a point of the fabric cap adjacent the side fabric panel to a point of the fabric cap adjacent the foot fabric panel.

30. The bed skirt of claim 29 further comprising a friction means for frictionally retaining a portion of the bed skirt between the box springs and the mattress during use.

31. The bed skirt of claim 30 wherein the friction means is a cord with a diameter of from about 8/32 inches to about 12/32 inches.

32. The bed skirt of claim 31 further comprising a corner cap for covering a corner of the box springs during use.

33. A bed skirt for covering the sides of a box springs, the bed skirt comprising:

a side fabric panel for covering a first side of a box springs during use having a box pleat positioned at a midpoint between ends of the side fabric panel;

a foot fabric panel for covering a second side of the box springs during use perpendicular to the first side of the box springs having a box pleat position at a midpoint between ends of the foot fabric panel, the foot fabric panel overlapping the side fabric panel;

a fabric cap connecting an edge of the side fabric panel to an edge of the foot fabric panel; and a pleated corner positioning the foot fabric panel and the side fabric panel in lapped relation providing multiplanar longitudinal movement of the side fabric panel, the multiplanar longitudinal movement providing means for adjusting the box pleat of the side fabric panel to be substantially aligned with a midpoint of the first side of the box springs, the pleated corner having a stitching connecting a point of the fabric cap adjacent the side fabric panel to a point of the fabric cap adjacent the foot fabric panel.

34. The bed skirt of claim 33 further comprising a friction means for frictionally retaining a portion of the bed skirt between the box springs and the mattress during use.

35. The bed skirt of claim 34 wherein the friction means is a cord with a diameter of from about 8/32 inches to about 12/32 inches.

36. The bed skirt of claim 35 further comprising a corner cap for covering a corner of the box springs during use.

* * * * *

UNITED STATES PATENT AND TRADEMARK OFFICE

CERTIFICATE OF CORRECTION

PATENT NO. : 6,912,745 B2
APPLICATION NO. : 10/444744
DATED : July 5, 2005
INVENTOR(S) : John F. Masoncup It is certified that error appears in the above-identified patent and that said Letters Patent is hereby corrected as shown below:

Column 1, line 36 “and” should be --end--.

Column 1, line 55, “effects” should be --affects--.

Column 1, line 61, “and” should be --end--.

Column 3, line 67, “an” should be --a--.

Column 7, line 17, “an” should be --a--.

Claim 19, Col. 60 line 10, “pleased” should be --pleated--.

Signed and Sealed this

Fifth Day of September, 2006

JON W. DUDAS
*Director of the United States Patent and Trademark Office*